US007764153B2

(12) United States Patent
Isogami et al.

(10) Patent No.: US 7,764,153 B2
(45) Date of Patent: Jul. 27, 2010

(54) MAGNETIC FIELD GENERATOR

(75) Inventors: Hisashi Isogami, Ushiku (JP); Norihide Saho, Tsuchiura (JP); Hiroyuki Tanaka, Mito (JP)

(73) Assignee: Hitachi, Ltd., Tokyo (JP)

( * ) Notice: Subject to any disclaimer, the term of this patent is extended or adjusted under 35 U.S.C. 154(b) by 76 days.

(21) Appl. No.: 12/018,501

(22) Filed: Jan. 23, 2008

(65) Prior Publication Data

US 2008/0246567 A1 Oct. 9, 2008

(30) Foreign Application Priority Data

Feb. 5, 2007 (JP) ..... 2007-026012

(51) Int. Cl.

| | |
|---|---|
| ***H01F 7/00*** | (2006.01) |
| ***H01F 1/00*** | (2006.01) |
| ***H01F 6/00*** | (2006.01) |
| ***H01F 5/00*** | (2006.01) |
| ***H01F 6/06*** | (2006.01) |

(52) U.S. Cl. ..... 335/216; 335/296; 335/300; 505/163; 505/892

(58) Field of Classification Search ..... 335/216, 335/296, 300; 505/163, 891–899; 62/51.1, 62/51.2, 51.3

See application file for complete search history.

(56) References Cited

U.S. PATENT DOCUMENTS

| | | | | |
|---|---|---|---|---|
| 4,765,153 | A * | 8/1988 | Wachi | 62/51.1 |
| 4,968,961 | A * | 11/1990 | Miyajima et al. | 335/216 |
| 5,410,286 | A * | 4/1995 | Herd et al. | 335/216 |
| 5,530,413 | A * | 6/1996 | Minas et al. | 335/216 |
| 5,686,876 | A * | 11/1997 | Yamamoto et al. | 335/216 |
| 5,724,820 | A * | 3/1998 | Iwasa | 62/51.1 |
| 5,787,714 | A * | 8/1998 | Ohkura et al. | 62/51.1 |
| 6,107,905 | A * | 8/2000 | Itoh et al. | 335/216 |
| 6,332,324 | B1 * | 12/2001 | Saho et al. | 62/51.1 |
| 6,828,889 | B1 * | 12/2004 | Zaput | 335/216 |
| 2005/0229620 | A1 * | 10/2005 | Kirichek et al. | 62/295 |
| 2007/0001792 | A1 * | 1/2007 | Nemoto et al. | 335/216 |
| 2007/0096740 | A1 * | 5/2007 | Fukuda et al. | 324/321 |
| 2008/0104966 | A1 * | 5/2008 | Stautner | 62/6 |
| 2009/0007573 | A1 * | 1/2009 | Noonan et al. | 62/51.1 |
| 2009/0045895 | A1 * | 2/2009 | Kasten | 335/216 |
| 2009/0272127 | A1 * | 11/2009 | Radovinsky et al. | 62/50.7 |

FOREIGN PATENT DOCUMENTS

| | | |
|---|---|---|
| JP | S57169564 | 10/1982 |
| JP | 02-298765 | 12/1990 |
| JP | 8-128742 | 5/1996 |

(Continued)

*Primary Examiner*—Elvin G Enad
*Assistant Examiner*—Mohamad A Musleh
(74) *Attorney, Agent, or Firm*—Antonelli, Terry, Stout & Kraus, LLP.

(57) ABSTRACT

A magnetic field generator comprises a superconducting bulk body, which generates a superconducting magnetic field, a refrigerant vessel for storing solid nitrogen, a vacuum container, which accommodates therein the superconducting bulk body and the refrigerant vessel, and a refrigerator having a cooling head for cooling the refrigerant vessel. The superconducting bulk body is arranged along a wall of the vacuum container. The cooling head of the refrigerator and the refrigerant vessel are in thermal contact with each other. The refrigerant vessel and the superconducting bulk body are in thermal contact with each other.

5 Claims, 8 Drawing Sheets

FOREIGN PATENT DOCUMENTS

| | | |
|---|---|---|
| JP | 10-275719 | 10/1998 |
| JP | 11-162726 | 6/1999 |
| JP | 11-283822 | 10/1999 |
| JP | 2002-208512 | 7/2002 |
| JP | 2004-186519 | 7/2004 |
| JP | 2005-116956 | 4/2005 |
| JP | 2005-210015 | 8/2005 |
| JP | 2006-112691 | 4/2006 |

* cited by examiner

MAGNETIC FIELD GENERATOR

BACKGROUND OF THE INVENTION

The present invention relates to a magnetic field generator, which generates a magnetic field, and more particular, to a magnetic field generator, which uses a superconducting magnet.

A superconducting magnet is used in MRI (Magnetic Resonance Imaging) apparatuses. The superconducting magnet is kept at extremely low temperature by liquid helium. The liquid helium is always cooled to temperatures equal to, or lower than its evaporating temperature.

MRI apparatuses are constructed so as to normally function even when power goes down. Backup power supplies are provided in hospitals against power failure. Further, even when a refrigerator stops, the heat capacity of the liquid helium inhibits temperature rise of a superconducting magnet. Accordingly, even when a refrigerator stops due to power failure, it is possible to maintain the superconducting magnet in a superconductive state for about two or three days or more.

JP-A-2005-116956 discloses an open type MRI apparatus, which uses a superconducting coil (superconducting magnet). The MRI apparatus is constructed so that a liquid helium vessel is surrounded by a heat shield, which is further surrounded by a vacuum container.

In recent years, high-temperature superconducting materials are developed, and therefore, it has become to make an electromagnetic coil from a high-temperature superconducting wire material. Since the high-temperature superconducting material is higher in critical temperature than metallic superconducting materials such as NbTi, etc., a superconductive state can be held by cooling with liquid helium, or direct cooling with a refrigerator. Further, the high-temperature superconducting material has an advantage that it is unnecessary to use a liquid helium, which is expensive and difficult to handle. With a superconducting magnet, however, the lower temperature becomes, the higher critical current value can be obtained. Therefore, a demand for utilization of a lower temperature than 77 K being a temperature of liquid nitrogen is increased.

JP-A-2002-208512 discloses a cooling construction making use of a high-temperature superconducting coil (superconducting magnet). With the cooling construction, the high-temperature superconducting coil (superconducting magnet) is cooled directly by a refrigerator and cold generated by the refrigerator is made use of to generate solid nitrogen. With the example described in JP-A-2002-208512, the solid nitrogen is made use of to inhibit temperature rise of the high-temperature superconducting coil when a refrigerator stops. Since the solid nitrogen has a large specific heat per weight as compared with other metals, etc., it is possible to make a whole apparatus lightweight.

With a MRI apparatus, which uses a superconducting magnet (superconducting coil), it is necessary to generate an intense magnetic field at a patient's position. With, for example, the open type MRI apparatus described in JP-A-2005-116956, it is preferable that a distance between upper and lower superconducting magnets is smaller. However, it is required that a sufficiently large space to arrange a patient be provided between the upper and lower superconducting magnets. Accordingly, it is not possible to make a distance between the upper and lower superconducting magnets smaller than a predetermined dimension.

Further, the construction shown in JP-A-2002-208512 involves a possibility that when a refrigerator stops due to power failure or malfunction, the superconducting magnet (superconducting coil) is increased in temperature by heat, which flows back from the refrigerator itself.

It is an object of the invention to provide a magnetic field generator capable of presenting an intense magnetic field in a position of use and further maintaining a superconductive state over a long term even when a refrigerator stops due to power failure, etc.

SUMMARY OF THE INVENTION

A magnetic field generator according to the invention comprises a superconducting bulk body which generates a superconducting magnetic field, a refrigerant vessel for containing solid nitrogen, a vacuum container which accommodates therein the superconducting bulk body and the refrigerant vessel, and a refrigerator having a cooling head for cooling the refrigerant vessel.

The superconducting bulk body is arranged along walls of the vacuum container. The cooling head of the refrigerator and the refrigerant vessel are in thermal contact with each other. The refrigerant vessel and the superconducting bulk body are in thermal contact with each other.

With the magnetic field generator according to the invention, it is possible to present an intense magnetic field in a position of use and further to maintain a superconductive state over a long term even when a refrigerator stops due to power failure, etc.

Other objects, features and advantages of the invention will become apparent from the following description of the embodiments of the invention taken in conjunction with the accompanying drawings.

DESCRIPTION OF THE PREFERRED EMBODIMENTS

Figure 1:
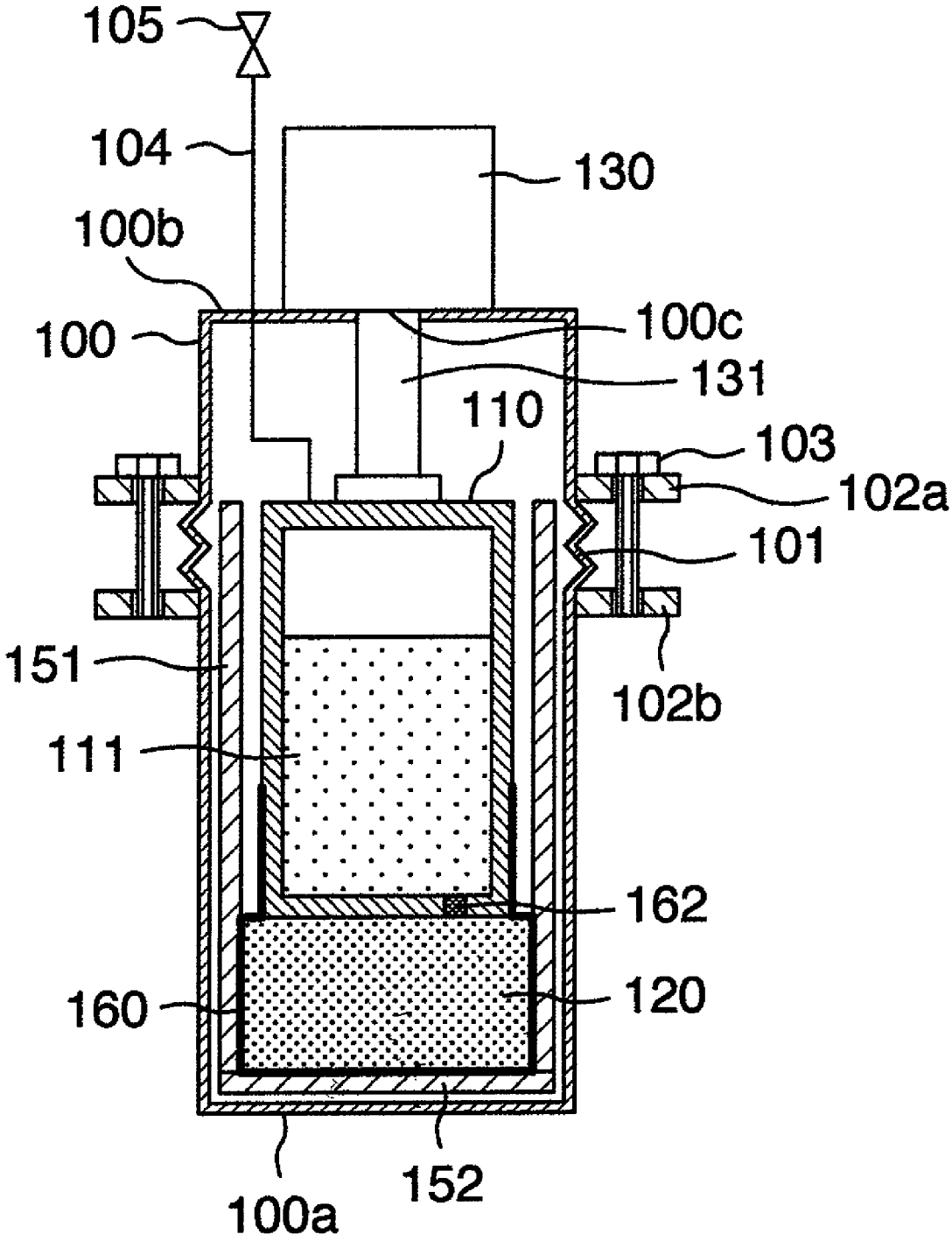
FIG. 1 is a view illustrating the construction of a magnetic field generator, according to the invention, for magnetic induction type DDS.

A first embodiment of a magnetic field generator according to the invention will be described with reference to FIG. 1. The magnetic field generator according to the present embodiment is one for magnetic induction type DDS (Drug Delivery System). With the magnetic induction type DDS, an agent (called a magnetic agent) added to magnetic fine grains is injected into a patient's body. A magnetic force is made use of to guide a magnetic agent to an affected part, thereby increasing the concentration of the agent in the affected part. Thus it is possible to increase the concentration of the agent in the affected part without increasing an amount of the agent being injected into a patient's body.

A magnetic induction type DDS needs a high magnetic field for guiding a magnetic agent in a patient's body, or a magnetic field generator for generation of a high magnetic gradient.

The magnetic field generator according to the embodiment includes a vacuum container 100, an interior of which is evacuated, a high-temperature superconducting bulk body 120 being a superconducting magnet for generating a superconducting magnetic field, a refrigerant vessel 110 for storing solid nitrogen 111, and a refrigerator 130 for cooling the refrigerant vessel 110. The vacuum container 100 is a closed container, an interior of which is maintained at high vacuum. Heat insulating materials 151, 152 are provided within the vacuum container 100. The high-temperature superconducting bulk body 120 and the refrigerant vessel 110 are arranged inside the heat insulating material 151.

It suffices that the high-temperature superconducting bulk body 120 be a bulk body, which makes a superconducting magnet, and typically, it is a superconductor such as an oxide superconductor having relatively high critical temperature. The oxide superconductor includes a yttrium oxide superconductor such as $Y_1Ba_2Cu_3O_{7-Y}$ ($0 \leqq Y<1$), etc., a bismuth oxide superconductor such as $Bi_2Sr_2Ca_1Cu_2O_{8-X}$, $Bi_2Sr_2Ca_2Cu_3O_{10-X}$, $(Bi, Pb)_2Sr_2Ca_1Cu_2O_{8-X}$, $(Bi, Pb)_2Sr_2Ca_2Cu_3O_{10-X}$ ($0 \leqq X<1$), etc., a thallium oxide superconductor such as $Tl_1Ba_2Ca_2Cu_3O_{9-X}$, $Tl_2Ba_2Ca_2Cu_3O_{10-Z}$ ($0 \leqq Z<1$), etc., and a rare earth oxide superconductor such as RE(sm, Gd)—Ba—Cu—O, etc. While the invention is most effective when said superconducting bulk bodies are used, a coil including the oxide superconductor described above, and a coil including $MgB_2$ having relatively high critical temperature may be used.

The high-temperature superconducting bulk body 120 and the refrigerant vessel 110 are in thermal contact with each other. A lower half of the refrigerant vessel 110 and a periphery of the bulk body 120 except a contact surface between the high-temperature superconducting bulk body 120 and the refrigerant vessel 110 are covered by a heat conducting plate 160. In addition, the matter "thermally contact" means a state of enabling thermal conduction between the both but it is not required that the both are physically directly contact with each other.

In the embodiment shown in FIG. 1, the high-temperature superconducting bulk body 120 is arranged along a bottom of the vacuum container 100. With the magnetic field generator according to the invention, however, it suffices that the high-temperature superconducting bulk body 120 be arranged along a wall surface of the vacuum container 100, and an arrangement of the refrigerant vessel 110 and the high-temperature superconducting bulk body 120 is not limited to the embodiment shown in FIG. 1.

For example, in the embodiment shown in FIG. 1, the refrigerant vessel 110 is arranged above the high-temperature superconducting bulk body 120. That is, the arrangement is of a vertical type. However, a horizontal type arrangement will do, in which the refrigerant vessel 110 is arranged laterally of the high-temperature superconducting bulk body 120 in the vacuum container 100.

The refrigerator 130 is arranged above the vacuum container 100. A hole 100*c* is provided on an upper surface 100*b* of the vacuum container 100. The refrigerator 130 is provided at a lower end thereof with a projecting cooling head 131. The cooling head 131 extends through the hole 100*c* on the upper surface of the vacuum container 100 to extend into the vacuum container and a lower end surface of the head is in thermal contact with the upper surface of the refrigerant vessel 110.

Thus, the refrigerant vessel 110 is cooled by the refrigerator 130, so that the solid nitrogen 111 in the refrigerant vessel 110 is maintained at a predetermined temperature. Since a bottom surface of the refrigerant vessel 110 and an upper surface of the high-temperature superconducting bulk body 120 is in thermal contact with each other, the high-temperature superconducting bulk body 120 is always cooled by the solid nitrogen 111.

The refrigerator 130 may comprise a GM refrigerator but may comprise a pulse tube refrigerator. The pulse tube refrigerator vibrates less and enables making a maintenance cycle relatively long. Also, since Stirling type refrigerators and Stirling type pulse tube refrigerators incorporate thereinto a compressor unitarily, it is possible to make a magnetic field generator small in size.

A temperature sensor 162 is provided on the bottom surface of the refrigerant vessel 110. A nitrogen supply line 104 is connected to the refrigerant vessel 110. The nitrogen supply line 104 extends outside the vacuum container 100 and is provided at an outer end thereof with a valve 105.

The valve 105 of the nitrogen supply line 104 comprises a check valve. The valve permits gases to pass outside the vacuum container 100 from an interior of the refrigerant vessel 110 but does not permit gases to pass in a reverse direction. Further, the valve 105 comprises a safety valve. When the temperature rises and liquid nitrogen in the refrigerant vessel 110 evaporates and the pressure in the refrigerant vessel 110 becomes equal to or higher than the atmospheric pressure, nitrogen is released outside the vacuum container 100 via the valve 105. Conversely, when the temperature becomes low and the pressure in the refrigerant vessel 110 becomes negative, an air does not enter into the refrigerant vessel 110 via the valve from outside the vacuum container 100.

The refrigerant vessel 110 is formed of a material such as copper and aluminum having a relatively high thermal conductivity. The heat conducting plate 160 is formed of a material such as copper and aluminum having a high thermal conductivity and a low thermal emissivity. In order to restrict thermal conduction in a thickness-wise direction, however, the heat conducting plate 160 may be formed of a material having an anisotropic thermal conductivity such that the thermal conductivity is low in the thickness-wise direction and high in a surface direction. Such material may be of a two-layered structure formed by sticking an inner layer, which is formed of paper or a resin sheet having a low thermal conductivity, and an outer layer, which is formed of a metallic sheet having a high thermal conductivity, together. Further, a carbon sheet may be used. In case of using a carbon sheet, lightening can be achieved by sticking an aluminum tape on a surface thereof, or covering the carbon sheet with an aluminum evaporated resin sheet in order to decrease emissivity of a surface.

The heat insulating materials 151, 152 may be composed of a laminate of a metallic foil and a resin sheet. The heat insulating materials may comprise a laminated structure, in which resin, such as polyester, with an aluminum evaporated surface and spacers composed of net or non-woven fabric made of polyester, polypropylene, and the like are multi-layered. In order to heighten the heat insulating materials 151, 152 in adiabatic function, it suffices to increase laminated layers in number. When the layers are increased in number, however, the thickness becomes large.

When the heat insulating material 152 arranged between the high-temperature superconducting bulk body 120 and a bottom surface 100*a* of the vacuum container 100 is increased in thickness, a distance between the bottom surface 100*a* of the vacuum container 100 and the bulk body 120 is increased. In this case, a magnetic field generated by the bulk body 120 cannot be made effective use of, which will be described later in detail.

While the vacuum container 100 is kept at room temperature, the solid nitrogen 111 and the high-temperature superconducting bulk body 120 are kept at extremely low temperatures. However, a vacuum space and the heat insulating materials 151, 152 are arranged between the vacuum container 100 and the refrigerant vessel 110. Heat entering from outside via the vacuum container 100 is cut off by the vacuum space and the heat insulating material 151 and so does not reach the refrigerant vessel 110. A vacuum space, the heat insulating materials 151, 152, and the heat conducting plate 160 are arranged between the vacuum container 100 and the high-temperature superconducting bulk body 120. Heat entering from outside via the vacuum container 100 is cut off by the vacuum space and the heat insulating materials 151, 152 and so does not reach the high-temperature superconducting bulk body 120. Even when a slight quantity of heat reaches the heat conducting plate 160 via the vacuum space and the heat insulating materials 151, 152, however, heat is transferred to the refrigerant vessel 110 from the heat conducting plate 160. Since the heat conducting plate 160 is low in thermal emissivity, the quantity of heat radiated to the high-temperature superconducting bulk body 120 from the heat conducting plate 160 is almost negligible. Thus the quantity of heat transferred to and the quantity of heat radiated to the high-temperature superconducting bulk body 120 are almost negligible.

Accordingly, heat entering from outside via the vacuum container 100 possibly reaches the refrigerant vessel 110 but does not reach the high-temperature superconducting bulk body 120.

The operation of the magnetic field generator according to the embodiment will be described. Liquid nitrogen is poured through the nitrogen supply line 104 into the refrigerant vessel 110. The refrigerant vessel 110 is in thermal contact with the cooling head 131 of the refrigerator 130 which has been cooled to about 30 K. Therefore, the liquid nitrogen is cooled to be the solid nitrogen 111. Helium, neon, hydrogen, and the like having a lower meniscus point than that of nitrogen may be charged together with the liquid nitrogen.

When the refrigerator 130 is stopped due to power failure or the like, the heat capacity of the solid nitrogen 111 makes it possible to moderate temperature rise of the bulk body 120. For example, since heat entering from outside through the wall of the vacuum container 100 is made use of for temperature rise of the solid nitrogen 111, the bulk body 120 is not increased in temperature. Further, heat back-flowing to the refrigerant vessel 110 through the refrigerator 130, which has been stopped, is made use of for temperature rise of the solid nitrogen in the refrigerant vessel 110. Accordingly, the bulk body 120 is not increased in temperature. Thus, according to the invention, heat entering from outside the magnetic field generator is first cut off by the heat insulating materials 151, 152. A slight quantity of heat having passed through the heat insulating materials 151, 152 reaches the refrigerant vessel 110. Since the heat resistance between the refrigerant vessel 110 and the solid nitrogen 111 is small, heat having reached the refrigerant vessel 110 is absorbed by the solid nitrogen 111. Solid nitrogen has a phase transition point, at which specific heat becomes large, around 36 K. Accordingly, the heat capacity of the solid nitrogen 111 can be made further effective use of by lowering the solid nitrogen to a lower temperature than the phase transition point.

Medical treatment by the magnetic induction type DDS is performed in a space outside the bottom surface 100*a* of the magnetic field generator. The magnetic field generated by the bulk body 120 is rapidly decreased with a distance from the bulk body 120. Accordingly, in order to obtain a magnetic field being large in strength in a position of medical treatment, it is preferable to arrange the position of medical treatment as close to the bulk body 120 as possible. With the magnetic field generator according to the embodiment, the bulk body 120 is arranged outside the refrigerant vessel 110. Accordingly, a distance between the bottom surface 100*a* of the vacuum container 100 and the bulk body 120 can be made very small at the bottom of the vacuum container. The position of the medical treatment is located close to the bulk body 120. Thus, according to the embodiment, a superconducting magnetic field generated by the magnetic field generator can be made effective use of with the magnetic induction type DDS.

With the magnetic field generator according to the embodiment, position regulation means composed of a bellows 101 and position regulation screws 103 is provided on the vacuum container 100. The position regulation means will be described hereinafter.

The position regulation means provided on the magnetic field generator according to the embodiment will be described with reference to FIG. 2. The position regulation means includes the bellows 101 and the position regulation screws 103. The bellows 101 is provided in an appropriate position between upper and lower portions of the vacuum container 100. A plate 102*a* having holes is provided above the bellows 101 and a plate 102*b* provided with threaded holes is provided below the bellows 101. The plates 102*a*, 102*b* are mounted to an outer wall of the vacuum container 100. The position regulation screws 103 extend through the holes of the upper plate 102*a* and are inserted to engage with the threaded holes of the lower plate 102*b*. A distance between the two plates 102*a*, 102*b* is varied by turning the position regulation screws 103, so that the bellows 101 expands and contracts. When the bellows 101 expands and contracts, a distance between the upper surface 100*b* and the bottom surface 100*a* of the vacuum container 100 is varied.

A distance between the upper surface 100*b* of the vacuum container 100 and the refrigerant vessel 110 is equal to a length of the cooling head 131 of the refrigerator 130 and constant at all times. Further, assuming that the refrigerant vessel 110 and the bulk body 120 are not deformed, the refrigerant vessel 110 and the bulk body 120 are constant in height. Accordingly, a distance between the upper surface 100*b* of the vacuum container 100 and the bottom surface of the bulk body 120 is always constant.

When the distance between the upper surface 100*b* and the bottom surface 100*a* of the vacuum container 100 is varied, a clearance between the bottom surface of the bulk body 120 and the bottom surface 100*a* of the vacuum container 100 is varied since the distance between the upper surface 100*b* of the vacuum container 100 and the bottom surface of the bulk body 120 is not varied. When the clearance between the bottom surface of the bulk body 120 and the bottom surface 100*a* of the vacuum container is varied, the heat insulating material 152 inserted thereinto is varied in thickness.

As described above, the heat insulating material 152 comprises a laminated structure and a space is formed between adjacent layers. Such space contributes to improvement in adiabatic function. When the heat insulating material 152 is compressed to become thin, spaces between layers disappear and adjacent layers come into contact with each other. Therefore, the adiabatic function is decreased.

With the magnetic field generator according to the embodiment, when the medical treatment by the magnetic induction type DDS is not performed, the position regulation means enlarges the clearance between the bottom surface of the bulk body 120 and the bottom surface 100*a* of the vacuum container as shown in FIG. 2A. Thereby, it is possible to adequately ensure the adiabatic function of the heat insulating material 152. When the medical treatment by the magnetic induction type DDS is to be performed, the position regulation means decreases the clearance between the bottom surface of the bulk body 120 and the bottom surface 100*a* of the vacuum container as shown in FIG. 2B. Thereby, the adiabatic function of the heat insulating material 152 is somewhat decreased but the position of medical treatment can be made close to the bulk body 120. Accordingly, the magnetic field generated by the bulk body 120 can be made effective use of in that position, in which the medical treatment by the magnetic induction type DDS is performed.

In addition, while the adiabatic function of the heat insulating material 152 is somewhat decreased but temperature rise of the bulk body 120 is restricted by the heat capacity of the solid nitrogen 111. The adiabatic function of the heat insulating material 152 can be again recovered by using the position regulation means to increase the distance between the bulk body 120 and the bottom surface 100*a* of the vacuum container when the medical treatment is terminated.

While the embodiment has shown the position regulation means, which makes use of the bellows, positional regulation may be carried out by position regulation means, which is structured otherwise. For example, the positional regulation may be performed by regulating forces of clamping screws for fixing a flange of the refrigerator, to adjust deflection of an O-ring used for sealing of the flange. The same effect as that described above can be produced.

Figure 2:
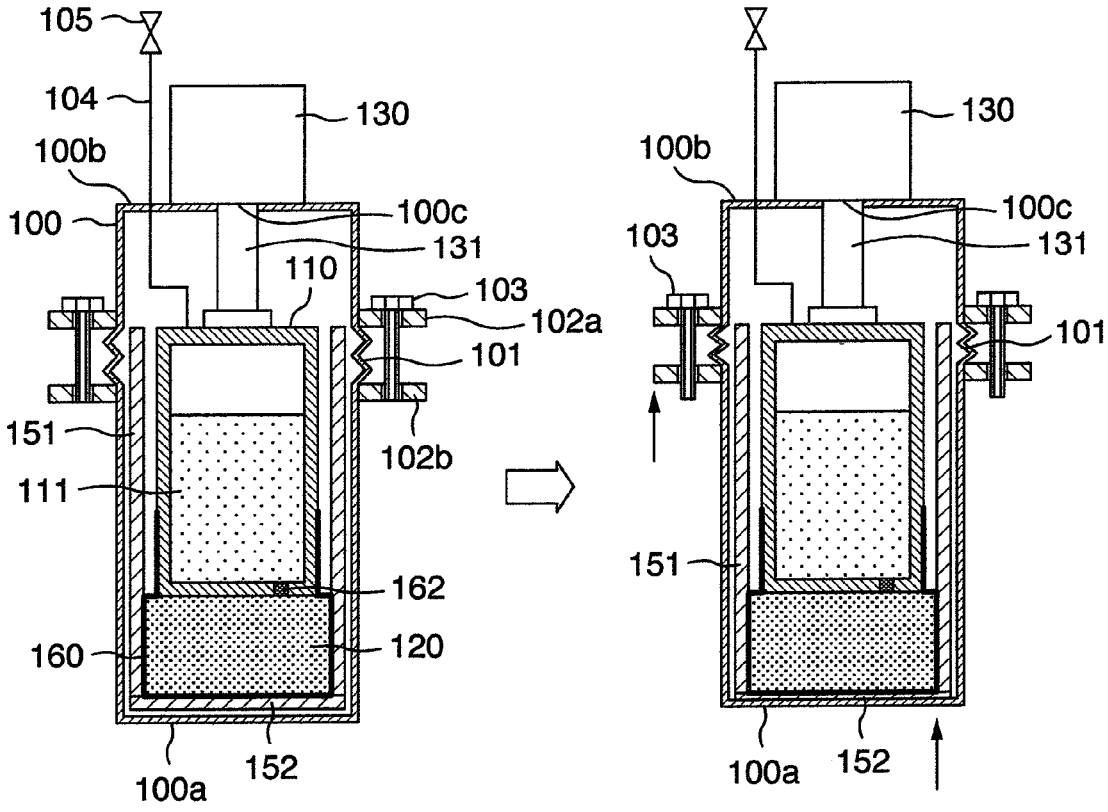
FIG. 2 is a view illustrating the function of the magnetic field generator, according to the invention, for magnetic induction type DDS.

According to the embodiment shown in FIG. 2, the bottom surface 100*a* of the vacuum container is exposed to the atmosphere on the bottom of the magnetic field generator. However, a heat insulating material serving as a cushioning material and having, for example, a curved surface may be provided on the bottom surface 100*a* of the vacuum container. Thereby, when the bottom surface 100*a* of the vacuum container is brought into contact with a patient's body, it is possible to prevent heat transfer by bodily temperature.

Further, while not shown in the drawings, one or more fins projecting inward may be provided on an inner wall of the refrigerant vessel 110. Thereby, a heat transfer area between the solid nitrogen 111 and the refrigerant vessel 110 is increased to enable increasing a quantity of heat transfer between the solid nitrogen 111 and the refrigerant vessel 110.

Figure 3:
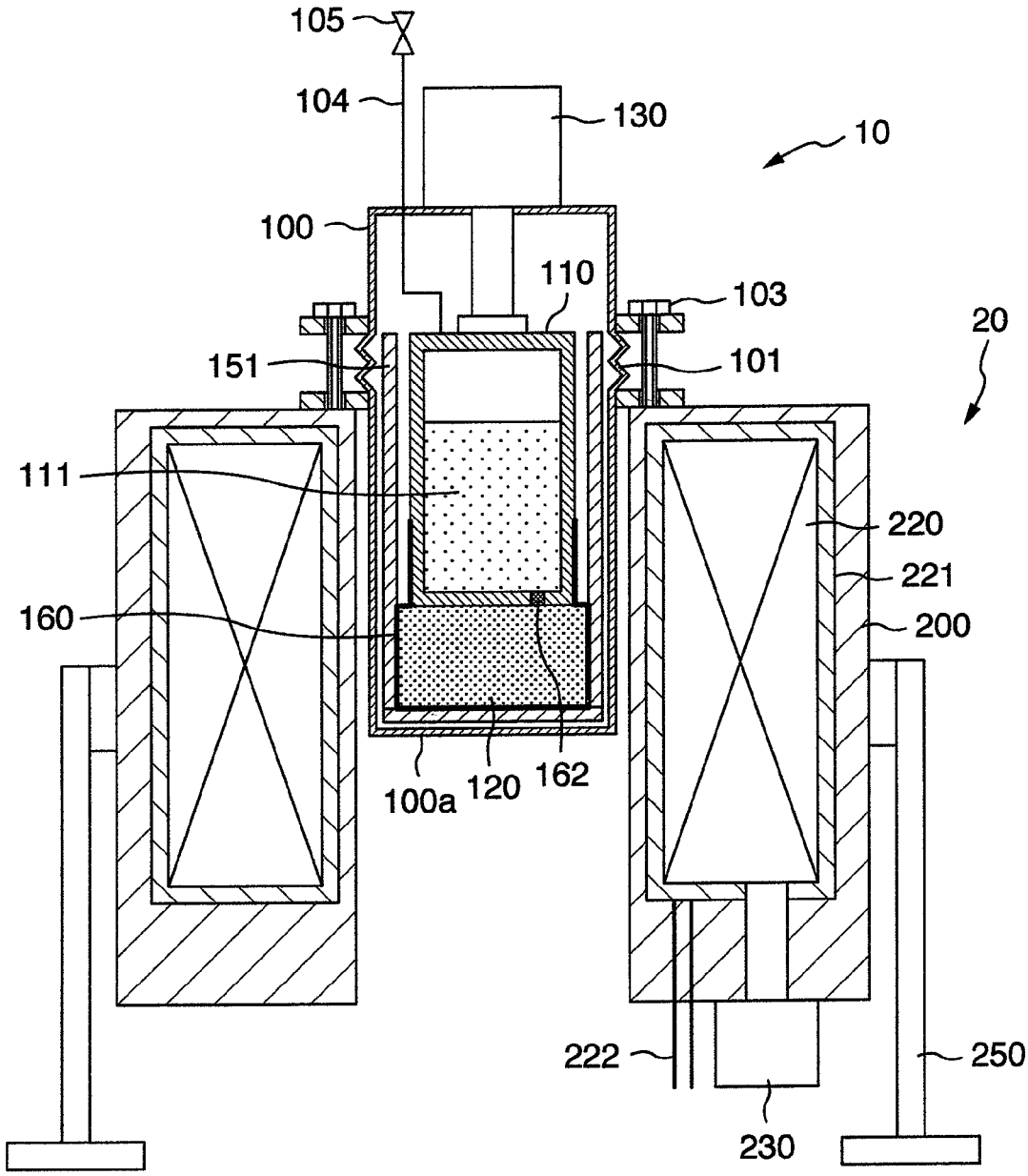
FIG. 3 is a view illustrating a way to polarize the magnetic field generator, according to the invention, for magnetic induction type DDS.

A way to polarize the magnetic field generator will be described with reference to FIG. 3. FIG. 3 shows a state, in which a polarizing device 20 is combined with the magnetic field generator 10 shown in FIG. 1. Polarization enables the bulk body 120 of the magnetic field generator 10 to generate a magnetic field. It is not required that the polarizing device 20 be provided every magnetic field generator but it is sufficient to provide a single polarizing device for a plurality of magnetic field generators. A single polarizing device is used in order whereby it is possible to polarize a plurality of magnetic field generators. Normally, it suffices that at least one polarizing device be mounted in a hospital or a land area.

The polarizing device 20 comprises a cylindrical-shaped superconducting coil 220, a vacuum insulation vessel 200, in which the superconducting coil 220 is accommodated, and a refrigerator 230 for cooling the superconducting coil 220. The superconducting coil 220 is formed from a superconducting material such as NbTi, $Nb_3Sn$, $MgB_2$ and covered by a heat-shield 221. The refrigerator 230 may comprise, for example, a two-stage GM refrigerator. The superconducting coil 220 is cooled to, for example, about 4 K by the refrigerator 230 to be put in a superconductive state. Electric current supplied through a power lead 222 causes the superconducting coil 220 to generate a magnetic field in the order of 5 to 15 T.

Normally, the refrigerator 230 is continuously operated to hold the superconducting coil 220 in a superconductive state. In polarizing the magnetic field generator, the magnetic field generator is mounted to the polarizing device 20 in a state of room temperature. The bulk body 120 in the magnetic field generator is arranged in a cylindrical hole of the superconducting coil 220 with a substantially central position along an axial direction. A superconducting magnetic field is generated by applying an electric current to the superconducting coil 220 via the power lead 222. The bulk body 120 is polarized by the magnetic field.

Subsequently, liquid nitrogen is poured through the nitrogen supply line 104 into the refrigerant vessel 110 of the magnetic field generator. Thereby, temperatures of the refrigerant vessel 110 and the bulk body 120 are lowered to the temperature 77 K of the liquid nitrogen at once. The valve 105 on the nitrogen supply line 104 is closed and the refrigerator 130 is started. Temperature of the refrigerant vessel 110 is further lowered by the refrigerator 130.

When the refrigerant vessel 110 is lowered in temperature, the liquid nitrogen solidifies from a portion thereof, which is in contact with the wall of the refrigerant vessel 110. The liquid nitrogen becomes a solid nitrogen to be cooled to the order of 30 to 35 K, which is a critical temperature of the bulk body 120 or lower.

Subsequently, current-carrying to the superconducting coil 220 is stopped to cut off the magnetic field for polarization. Even when the current-carrying to the superconducting coil 220 is stopped, an eddy current generated in the bulk body 120 continues to flow as far as the bulk body 120 is held in a superconductive state. Magnetic flux passing through the bulk body 120 is generated by the eddy current. A magnetic field is formed around the bulk body 120 by trapping the magnetic flux. The magnetic field continues to generate as far as the bulk body 120 is held in a superconductive state.

Subsequently, an increase in refrigerating capacity is achieved by changing the refrigerator 230 in frequency, or increasing the refrigerator 230 in charging pressure. When the bulk body 120 is further lowered thereby in temperature, it is possible to stably hold the magnetic field trapped by the bulk body. Instead of increasing the refrigerator in refrigerating capacity, a heater beforehand arranged in the vicinity of the bulk body may be cut off. Alternatively, before the bulk body is adequately cooled by the refrigerator, current-carrying to the superconducting coil 220 may be stopped and the bulk body may be adequately cooled by the refrigerator. Since these operations are performed on the basis of a signal from the temperature sensor 162 provided in the vicinity of the bulk body, the work of polarization can be efficiently carried out.

A second embodiment of a magnetic field generator according to the invention will be described with reference to FIG. 4. Here, an explanation will be given to how the magnetic field generator according to the second embodiment is different from that according to the first embodiment in FIG.

1. While the refrigerator 130 is fixed to the refrigerant vessel 110 according to the first embodiment shown in FIG. 1, a refrigerator 130 according to the second embodiment is removably fixed to a refrigerant vessel 110. A hole 112 having a taper 113 is provided on an upper surface of the refrigerant vessel 110. Likewise, a hole 100*c* is provided on the upper surface 100*b* of the vacuum container 100. A cylindrical-shaped refrigerator port 140 is provided to connect between the hole 112 on the upper surface of the refrigerant vessel 110 and the hole 100*c* on the upper surface of the refrigerant vessel.

The nitrogen supply line 104 is connected to the refrigerant vessel 110. The nitrogen supply line 104 extends outside the vacuum container 100 and the valve 105 is provided at an outer end of the nitrogen supply line 104. The nitrogen supply line 104 is connected to the port 140. A nitrogen supply line 144 extends outside the vacuum container 100 and a valve 145 is provided at an outer end of the nitrogen supply line 144. Nitrogen is supplied to the port 140 through the nitrogen supply line 144. Accordingly, an interior of the port 140 is filled with nitrogen.

The refrigerator 130 is provided above the vacuum container 100. The cooling head 131 of the refrigerator 130 extends through the hole 100*c* in the upper surface 100*b* of the vacuum container 100 to extend into the port 140. A cooling member 132 is mounted to a lower end of the cooling head 131. The cooling member 132 is tapered. A ring-shaped tapered surface of the cooling member 132 at the lower end of the cooling head 131 is in thermal contact with a conical-shaped tapered surface 113 of the hole 112 on the upper surface of the refrigerant vessel 110.

The cooling member 132 and the refrigerant vessel 110 are formed of materials, which are high in thermal conductivity. Since the both are in thermal contact with each other at the tapered surfaces thereof, however, it is desired that they be formed of materials having the same thermal conductivity. The cooling member 132 and the refrigerant vessel 110 may be formed of the same material. Further, the port 140 is formed of a material having a low thermal conductivity. The reason for this is that it is aimed at preventing heat entering from outside from being transferred to the refrigerant vessel 110 through the port 140. Materials being low in thermal conductivity include stainless steel, FRP, etc. However, the port 140 supports the cooling head 131 of the refrigerator 130. Accordingly, the port 140 may be formed of the same material as that of the cooling head 131.

Accordingly, the port 140 may be formed of stainless steel being the same material as that of the cooling head 131 of the refrigerator 130. Further, it is desired that the port 140 be in the form of a bellows.

With the magnetic field generator according to the second embodiment, the cooling member 132 at the lower end of the cooling head 131 and the hole 112 in the upper surface of the refrigerant vessel 110 are in thermal contact with each other. Contact surfaces of the both comprise a narrow ring-shaped tapered surfaces. An interior of the refrigerant vessel 110 is closed by the contact surfaces. When the cooling member 132 of the refrigerator 130 is cooled, nitrogen in the port 140 solidifies to intrude into a contact region between the cooling member 132 and the hole 112 of the refrigerant vessel 110. Thereby, thermal contact between the cooling member 132 at the lower end of the cooling head 131 and the hole 112 in the upper surface of the refrigerant vessel 110 becomes favorable and further the refrigerant vessel 110 is improved in quality of closeness. Thus, the refrigerant vessel 110 can be cooled by the refrigerator 130. At the same time, when an interior of the port 140 is cooled by the refrigerator 130 and nitrogen solidifies, it is put at a negative pressure. The interior of the port 140 finally becomes a degree of vacuum in the same order as that of the vacuum container. Therefore, the port 140 provides an adiabatic function to prevent heat from entering from outside through the upper surface of the refrigerant vessel or the hole in the upper surface.

With the magnetic field generator according to the second embodiment, since the refrigerator 130 is readily removed, maintenance of the refrigerator 130 becomes easy. Further, when the liquid nitrogen is to be poured into the refrigerant vessel 110 at the time of polarization, the refrigerator 130 is removed whereby the liquid nitrogen can be poured into the refrigerant vessel 110 through the port 140 and the hole 112 in the upper surface of the refrigerant vessel 110. Accordingly, the work of charging the liquid nitrogen is completed simply in a short period of time.

The valve 145 provided on the nitrogen supply line 144 functions as a safety valve. When the interior of the port 140 is increased in temperature due to power failure or the like, nitrogen in the port 140 is permitted to escape to the atmosphere. Like the first embodiment, position regulation means may be provided in the second embodiment.

Further, since the magnetic field generator according to the second embodiment comprises the refrigerator of a detachable type, it may be used in a state, in which the refrigerator 130 is removed, when the medical treatment by the magnetic induction type DDS is performed. The refrigerator 130 is removed and a lid closes the hole 112 in the upper surface of the refrigerant vessel 110 and the hole 100*c* in the upper surface 100*b* of the vacuum container 100. Even when the refrigerator 130 is removed, the heat capacity of the solid nitrogen in the refrigerant vessel 110 suppresses temperature rise of the bulk body 120. Thus, the magnetic field generator according to the second embodiment can perform medical treatment as a small-sized magnetic field generator without the refrigerator 130. Helium, neon, hydrogen, and the like having a lower liquefaction point than that of nitrogen may be charged into the refrigerant vessel 110 together with the liquid nitrogen. Thereby, it is also possible to generate solid nitrogen in a state, in which internal pressure in the refrigerant vessel 110 is made positive. In this case, the danger that the atmosphere flows into the refrigerant vessel 110 is decreased, so that the work of removing the refrigerator 130 is facilitated.

A third embodiment of a magnetic field generator according to the invention will be described with reference to FIG. 5. Here, an explanation will be given to how the magnetic field generator according to the third embodiment is different from that according to the second embodiment shown in FIG. 4. While the hole is provided in the upper surface of the refrigerant vessel 110 according to the second embodiment shown in FIG. 4, any hole is not provided in an upper surface of the refrigerant vessel 110 in the present embodiment. An engagement portion 115 is provided on the upper surface of the refrigerant vessel 110. The engagement portion 115 comprises a conical-shaped tapered surface.

The cylindrical-shaped refrigerator port 140 is provided to connect between the engagement portion 115 on the upper surface of the refrigerant vessel 110 and the hole 100*c* in an upper surface 100*b* of the refrigerant vessel 100.

The refrigerator 130 is provided above the vacuum container 100. The cooling head 131 of the refrigerator 130 extends through the hole 100*c* in the upper surface 100*b* of the vacuum container 100 to extend into the port 140. The cooling member 132 is mounted to a lower end of the cooling head 131. The cooling member 132 is tapered. A ring-shaped tapered surface of the cooling member 132 at the lower end of the cooling head 131 is in thermal contact with a conical-shaped tapered surface of the engagement portion 115 on the upper surface of the refrigerant vessel 110.

With the magnetic field generator according to the present embodiment, it is unnecessary to charge nitrogen into the refrigerator port 140. That is, the port 140 may be put in a state of being charged with an air of the atmosphere. However, a small quantity of water may be poured into the port 140 to form ice between the ring-shaped tapered surface of the cooling member 132 at the lower end of the cooling head 131 and the conical-shaped tapered surface of the engagement portion 115 on the upper surface of the refrigerant vessel 110. Thus, thermal contact between the both may be formed by ice having a high thermal conductivity.

Figure 4:
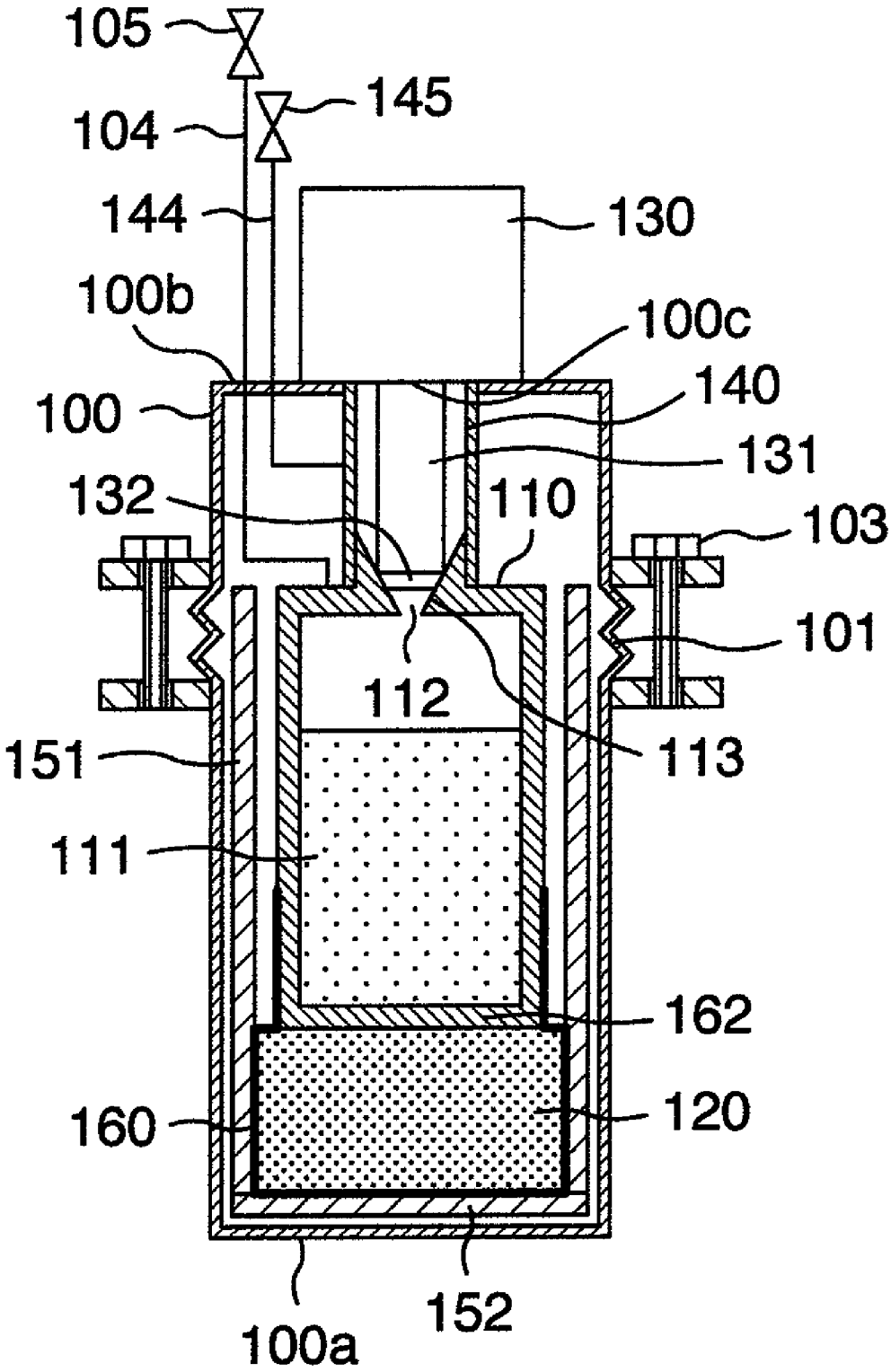
FIG. 4 is a view illustrating the construction of a second embodiment of a magnetic field generator, according to the invention, for magnetic induction type DDS.
Figure 5:
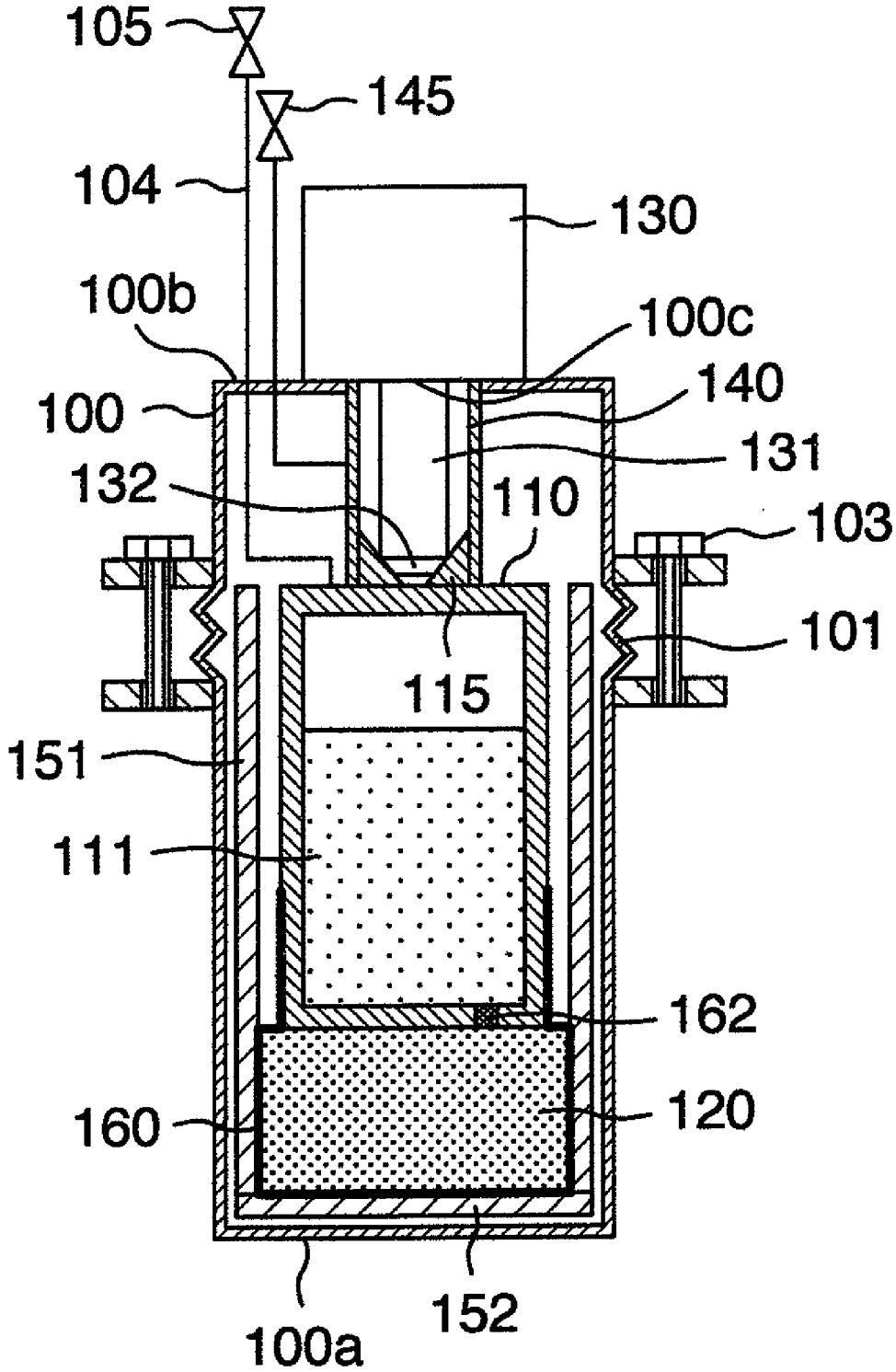
FIG. 5 is a view illustrating the construction of a third embodiment of a magnetic field generator, according to the invention, for magnetic induction type DDS.

The refrigerator 130 in the magnetic field generator according to the present embodiment can be removed in the same manner as in the second embodiment shown in FIG. 4. The engagement portion 115 is manufactured as a separate part from the refrigerant vessel 110 and connected to the upper surface of the refrigerant vessel 110 as by welding or the like. Likewise, the refrigerator port 140 is manufactured as a separate part from the refrigerant vessel 110 and the vacuum container 100 and connected to the refrigerant vessel 110 and the vacuum container 100 as by welding or the like. The magnetic field generator according to the present embodiment has an advantage that the refrigerant vessel 110 and the refrigerator port 140 are made simple in structure and simple to manufacture.

Figure 6:
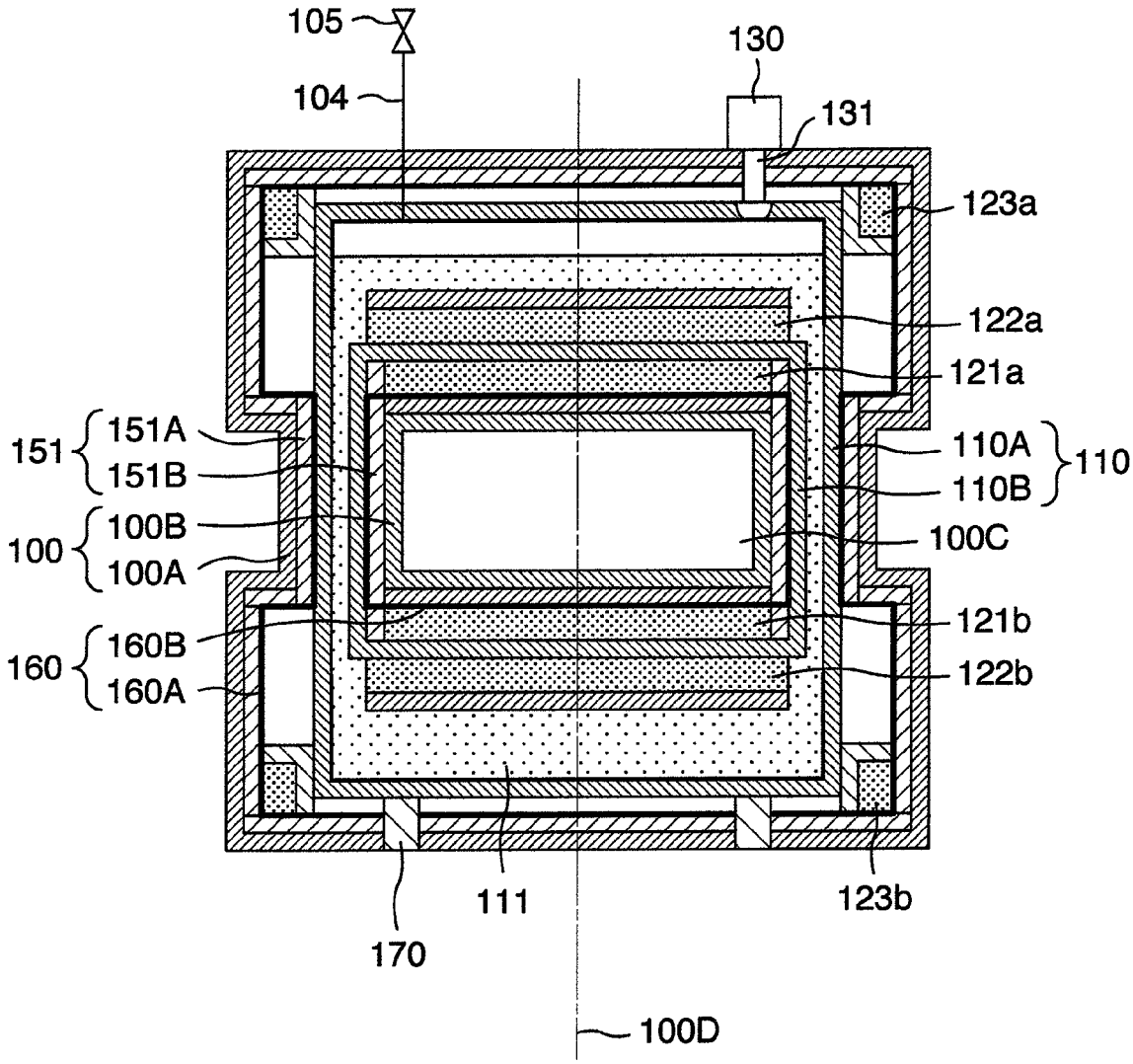
FIG. 6 is a view illustrating the construction of a MRI apparatus using a magnetic field generator according to the invention.

A MRI (nuclear magnetic resonance imaging) apparatus making use of the magnetic field generator according to the invention will be described with reference to FIG. 6. The MRI apparatus in the embodiment uses a high-temperature superconducting bulk body of the magnetic field generator as a superconducting magnet.

The MRI apparatus in the embodiment includes a vacuum container 100 having an outer wall 100A and an inner wall 100B. A space between the outer wall 100A and the inner wall 100B of the vacuum container is evacuated and provides therein a refrigerant vessel 110, which includes an outer wall 110A and an inner wall 110B and accommodates therein solid nitrogen 111.

A refrigerator 130 for cooling the refrigerant vessel 110 is provided on an upper, outer wall of the vacuum container 100. A cooling head 131 of the refrigerator 130 extends through the outer wall of the vacuum container 100 to be in contact with the outer wall 110A of the refrigerant vessel 110. A patient is arranged in a space 100C radially inwardly of the inner wall 100B of the vacuum container 100.

Heat insulating materials 151A, 151B are respectively provided radially inwardly of the outer wall 100A of the vacuum container 100 and radially outwardly of the inner wall 100B of the vacuum container 100. Heat conducting plates 160A, 160B are respectively provided radially inwardly of the heat insulating material 151A on the outer wall of the vacuum container 100 and radially outwardly of the heat insulating material 151B on the inner wall of the vacuum container. The refrigerant vessel 110 is arranged between the heat conducting plates 160A, 160B.

The MRI apparatus in the embodiment includes a first disk-shaped high-temperature superconducting bulk body 121*a* above the space 100C, in which a patient is arranged, a second disk-shaped high-temperature superconducting bulk body 121*b* below the space 100C, and third and fourth high-temperature superconducting bulk bodies 122*a*, 122*b* arranged further radially outwardly thereof. The MRI apparatus in the embodiment further includes two ring-shaped high-temperature superconducting bulk bodies 123*a*, 123*b*, which are arranged vertically along the outer wall of the vacuum container. The heat insulating materials 151A, 151B are provided around the high-temperature superconducting bulk bodies. The ring-shaped high-temperature superconducting bulk bodies 123*a*, 123*b* function to regulate the uniformity of a magnetic field and to prevent leakage of the magnetic field.

The MRI apparatus in the embodiment is an open type MRI apparatus, in which the high-temperature superconducting bulk bodies are arranged axially symmetrically with respect to a vertical axis 100D and the high-temperature superconducting bulk bodies are arranged above and below the space 100C, in which a patient is arranged.

The high-temperature superconducting bulk bodies 121*a*, 121*b*, 122*a*, 122*b*, 123*a*, 123*b* are set in structure, arrangement, and position to optimum values so that the field strength in a central position of the space 100C, in which a patient is arranged, the field uniformity in the space 100C, and the leakage field strength outside the MRI apparatus meet specified values.

The first and second high-temperature superconducting bulk bodies 121*a*, 121*b* and the third and fourth high-temperature superconducting bulk bodies 122*a*, 122*b* are in thermal contact with the solid nitrogen 111 in the refrigerant vessel 110. The fifth and sixth high-temperature superconducting bulk bodies 123*a*, 123*b* are in thermal contact with the outer wall of the refrigerant vessel 110.

The solid nitrogen 111 in the refrigerant vessel 110 is cooled by the refrigerator 130. The high-temperature superconducting bulk bodies are always cooled to predetermined temperatures by the solid nitrogen 111 in the refrigerant vessel 110. Even when the refrigerator 130 is stopped, the heat capacity of the solid nitrogen 111 in the refrigerant vessel 110 eliminates temperature rise of the high-temperature superconducting bulk bodies.

The first and second high-temperature superconducting bulk bodies 121*a*, 121*b* are arranged close to the space 100C, in which a patient is arranged. That is, the first and second high-temperature superconducting bulk bodies 121*a*, 121*b* are arranged between the inner wall of the refrigerant vessel 110 and the space 100C, in which a patient is arranged. It is possible to arrange the first and second high-temperature superconducting bulk bodies 121*a*, 121*b* close to a patient.

Since the fifth and sixth high-temperature superconducting bulk bodies 123*a*, 123*b* are arranged outside the refrigerant vessel 110, the refrigerant vessel 110 can be made dimensionally small. When the refrigerant vessel 110 can be made dimensionally small, it is possible to make the magnetic field generator dimensionally small.

With the MRI apparatus in the embodiment, when a coil made of superconducting wire is used instead of a high-temperature superconducting bulk body, it is necessary to arrange the coil outside the refrigerant vessel 110. In this case, the cooling stability of the coil becomes unstable. Further, it is necessary to connect a current wire between a coil and a coil, which results in that the current wire extends through a refrigerant vessel. Accordingly, the use of a coil leads to complexity in construction and a danger that a refrigerant leaks from a refrigerant vessel. In contrast, when a high-temperature superconducting bulk body is used as in the embodiment, local quench does not become critical as with a wire material but the stability is high and since it is unnecessary to connect a wire between magnets, the construction is made very simple.

With the MRI apparatus in the embodiment, the weight of the high-temperature superconducting bulk bodies and the refrigerant vessel 110 is born by support bodies 170. The support bodies 170 are formed of a material, such as FRP (fiber reinforced plastics), etc., having a low thermal conductivity. Thereby, heat conduction is prevented from being caused via the support bodies 170.

The vacuum container of the MRI apparatus in the embodiment may use position regulation means as shown in the first embodiment in FIG. 1.

Figure 7:
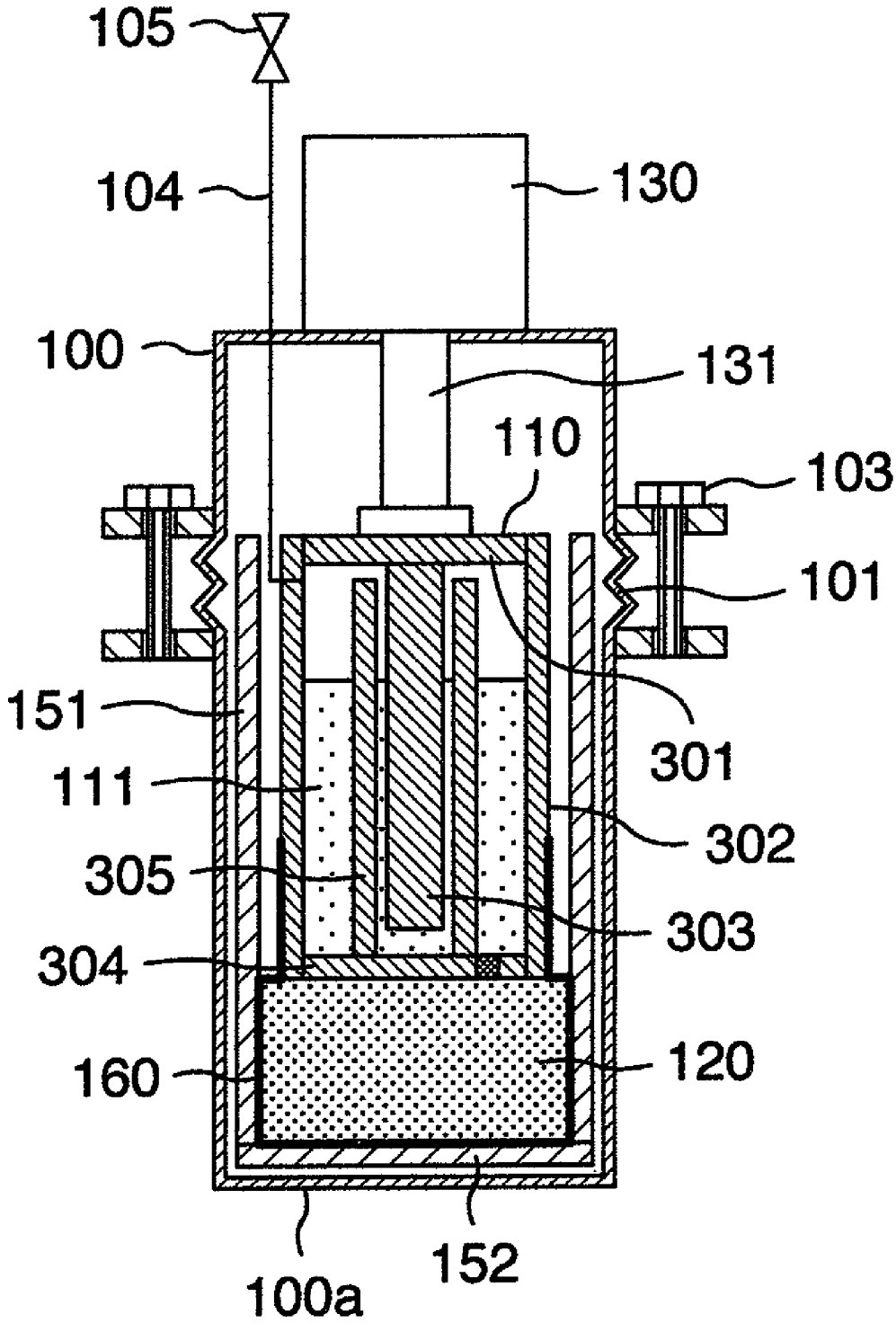
FIG. 7 is a view illustrating the construction of a fourth embodiment of a magnetic field generator, according to the invention, for magnetic induction type DDS.
Figure 8:
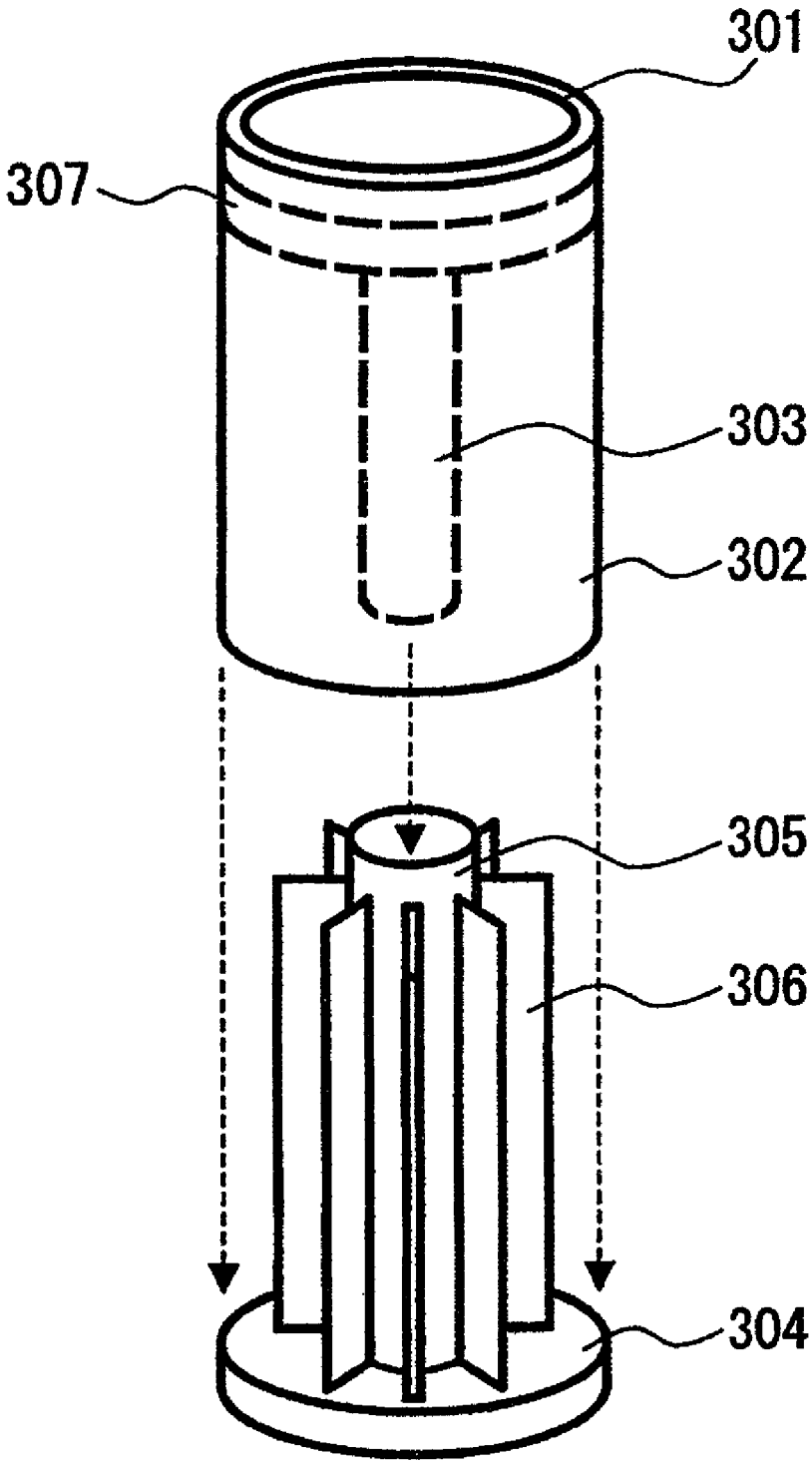
FIG. 8 is a view illustrating the construction of a refrigerant vessel of the fourth embodiment of a magnetic field generator, according to the invention, for magnetic induction type DDS.

A fourth embodiment of a magnetic field generator according to the invention will be described with reference to FIGS. 7 and 8. With the magnetic field generator according to the present embodiment, a refrigerant vessel 110 is differently structured as compared with the first embodiment shown in FIG. 1. Here, description will be given to the refrigerant vessel 110 in the magnetic field generator according to the present embodiment. FIG. 7 shows a cross sectional construction of the magnetic field generator according to the present embodiment and FIG. 8 shows the construction of the refrigerant vessel 110 in the magnetic field generator according to the present embodiment. As shown in FIG. 8, the refrigerant vessel 110 in the embodiment includes a flange 301 on which a refrigerator is mounted, an upper heat conduction rod 303, a cylindrical member 302, a bulk magnet side flange 304, and a lower heat conduction rod 305. In addition, a heat insulating material 307 is mounted to the flange 301. A plurality of fins 306 are provided around the lower heat conduction rod 305. The upper heat conduction rod 303 is formed to be columnar in shape and the lower heat conduction rod 305 is formed to be cylindrical in shape. The lower heat conduction rod 305 is provided with a multiplicity of holes (not shown). An outside diameter of the upper heat conduction rod 303 is slightly smaller than an inside diameter of the lower heat conduction rod 305.

In assembling the refrigerant vessel 110, the upper heat conduction rod 303 is inserted into the lower heat conduction rod 305 and the cylindrical member 302 connects between the refrigerator side flange 301 and the bulk magnet side flange 304. A clearance between an outer surface of the upper heat conduction rod 303 and an inner surface of the lower heat conduction rod 305 is in the order of 0.5 mm. As shown in FIG. 7, lengths of the upper heat conduction rod 303 and the lower heat conduction rod 305 are somewhat shorter than a distance between the refrigerator side flange 301 and the bulk magnet side flange 304. Therefore, the upper heat conduction rod 303 does not come into contact with the bulk magnet side flange 304 and the lower heat conduction rod 305 does not come into contact with the refrigerator side flange 301.

Here, the case is described where the upper heat conduction rod 303 is formed to be columnar in shape and the lower heat conduction rod 305 is formed to be cylindrical in shape. However, the upper heat conduction rod 303 may be formed to be cylindrical in shape and the lower heat conduction rod 305 may be formed to be columnar in shape. In this case, fins are provided around the upper heat conduction rod 303. Further, the case is described where a single, upper heat conduction rod 303 and a single, lower heat conduction rod 305 are provided but a plurality of upper heat conduction rods 303 and a plurality of lower heat conduction rods 305 may be provided.

The refrigerator side flange 301 and the upper heat conduction rod 303 are formed of a material, such as aluminum, copper, stainless steel, etc., having a high thermal conductivity. While the refrigerator side flange 301 and the upper heat conduction rod 303 may be connected together as by welding or silver soldering but may be manufactured as an integral part. The cylindrical member 302 and the heat insulating material 307 are formed of a material, such as FRP, etc., having a low thermal conductivity.

The bulk magnet side flange 304, the lower heat conduction rod 305, and the fins 306 are formed of a material, such as aluminum, copper, stainless steel, etc., having a high thermal conductivity. The bulk magnet side flange 304 and the lower heat conduction rod 305 may be connected together as by welding or silver soldering but may be manufactured as an integral part. All the flanges 301, 304 and the heat conduction rods 303, 305 may be formed of the same material having a high thermal conductivity.

As shown in FIG. 7, when liquid nitrogen is poured into the refrigerant vessel 110, the liquid nitrogen enters inside the lower heat conduction rod 305 through the holes in the lower heat conduction rod 305 to surround the periphery of the upper heat conduction rod 303. Parts, which constitute the refrigerant vessel 110, thermally contract owing to the liquid nitrogen. The flanges 301, 304 and the heat conduction rods 303, 305 are formed of a material having a high thermal conductivity and so it is possible to neglect differences in thermal contraction among the members. For example, the flanges 301, 304 and the heat conduction rods 303, 305 may be formed of the same material having a high thermal conductivity. Accordingly, even when the flanges 301, 304 and the heat conduction rods 303, 305 thermally contract, the upper heat conduction rod 303 and the lower heat conduction rod 305 will not come into contact with each other. Also, the refrigerator side flange 301 and the lower heat conduction rod 305 will not come into contact with each other and the bulk magnet side flange 304 and the upper heat conduction rod 303 will not come into contact with each other. On the other hand, differences in thermal contraction are generated among the flanges 301, 304 and the heat conduction rods 303, 305, which are formed of a material having a high thermal conductivity, and the cylindrical member 302 formed of a material having a low thermal conductivity. Accordingly, there is a possibility that thermal stresses attributable to differences in thermal contraction are generated in contact regions between the flanges 301, 304 and the cylindrical member 302. However, the cylindrical member 302 is formed of an elastically deformable material. Therefore, the cylindrical member 302 is elastically deformed to absorb the differences in thermal contraction. Accordingly, no thermal stresses are generated in the flanges 301, 304. Thus, the refrigerant vessel 110 in the embodiment will not be broken by thermal stresses attributable to differences in thermal contraction.

Subsequently, the refrigerator 130 cools the refrigerant vessel 110. The refrigerator side flange 301, which is in thermal contact with the cooling head 131 of the refrigerator 130, is cooled. When the refrigerator side flange 301 is cooled, the upper heat conduction rod 303 is cooled due to heat conduction. The liquid nitrogen in the refrigerant vessel 110 solidifies starting from a surface thereof, which is most cooled. Accordingly, the liquid nitrogen solidifies starting from a surface of the upper heat conduction rod 303. The heat insulating material 307 formed of FRP, etc. is provided on the surface of the refrigerator side flange 301. Therefore, adherence of solid nitrogen to the surface of the refrigerator side flange 301 is avoided. The solid nitrogen generated on the surface of the upper heat conduction rod 303 grows to fill in a space between the upper heat conduction rod 303 and the lower heat conduction rod 305 in due course. Thus, a heat path composed of the solid nitrogen is formed between the upper heat conduction rod 303 and the lower heat conduction rod 305. The lower heat conduction rod 305 is cooled via the heat path. When the lower heat conduction rod 305 is cooled, the bulk magnet side flange 304 is cooled due to heat conduction. Thereby, the high-temperature superconducting bulk body 120 is cooled. The fins 306 are provided on the lower heat conduction rod 305. The fins 306 contribute to an increase in a heat transfer surface. Therefore, it is possible to effectively generate the solid nitrogen around the lower heat conduction rod 305.

As described above, the lower heat conduction rod 305 is provided with a plurality of holes (not shown). Therefore, even when nitrogen solidifies partially in a space between the upper heat conduction rod 303 and the lower heat conduction rod 305, fresh liquid nitrogen flows into the space through the holes of the lower heat conduction rod 305.

As described above, the cylindrical member 302 of the refrigerant vessel 110 in the embodiment is formed of a material, such as FRP, etc., having a low thermal conductivity. Therefore, even when radiant heat enters from outside, temperature of the cylindrical member 302 does not become low in the order of internal temperature of the refrigerant vessel 110. For example, when the nitrogen supply line 104 is connected to the cylindrical member 302, there is not caused a problem that the connection is lowered in temperature to generate solid nitrogen to plug up the nitrogen supply line 104. Also, when the refrigerator 130 is stopped, heat back-flows from the refrigerator 130. In this case, the upper heat conduction rod 303 is first increased in temperature and the solid nitrogen in the vicinity of the surface of the upper heat conduction rod 303 melts. Thereby, the heat path composed of the solid nitrogen between the upper heat conduction rod 303 and the lower heat conduction rod 305 is shut off. Therefore, heat back-flowing from the refrigerator 130 becomes difficult to transfer to the lower heat conduction rod 305 from the upper heat conduction rod 303, so that it is possible to reduce influences on the bulk magnet temperature.

While the embodiments of the invention have been described, the invention is not limited thereto but it is readily understood by those skilled in the art that various modifications are enabled within the scope of the invention described in the claims.

For example, the case has been described where the magnetic field generator according to the invention is used in a magnetic induction type drug delivery system and an open type MRI apparatus. However, the magnetic field generator according to the invention is not limited to these examples but can be made use of in other medical appliances, in which a superconducting magnet is applied, such as cylindrical-shaped magnet (horizontal magnetic field) type MRI apparatuses, NMR (nuclear magnetic resonance) apparatuses based on the same principle as that of MRI, magnetism applying blood purifiers, etc.

Further, the magnetic field generator according to the invention is usable not only in medical appliances but also in purifiers for water, etc., toxic substance strippers, magnetic chromatography, etc., in which magnetic separation using a superconducting magnet and the principle of magnetic induction are made use of. Further, the magnetic field generator according to the invention is usable for superconducting magnets of linear motor cars.

The invention is applicable to superconducting magnets used in medical appliances such as MRI apparatuses, nuclear magnetic resonance imaging apparatuses, magnetic induction type drug delivery systems, etc.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A magnetic field generator comprising: a high-temperature superconductor, which generates a superconducting magnetic field; a refrigerant vessel for storing a solid nitrogen; a vacuum container, which accommodates therein the high-temperature superconductor and the refrigerant vessel; and a refrigerator having a cooling head for cooling the refrigerant vessel, wherein the superconductor is arranged along a wall of the vacuum container, the cooling head of the refrigerator and the refrigerant vessel are in thermal contact with each other, and the refrigerant vessel and the superconductor are in thermal contact with each other, and wherein the vacuum container is provided with position regulation means comprising a bellows provided between upper and lower portions of the vacuum container and a position regulation device, so that a distance between an upper surface and a bottom surface of the vacuum container is varied by expanding/contracting the bellows by means of the position regulation device, whereby a clearance between a bottom surface of the superconductor and the bottom surface of the vacuum container is varied.

2. The magnetic field generator according to claim 1, wherein the superconductor and the refrigerant vessel are surrounded by a heat insulating material.

3. The magnetic field generator according to claim 1, wherein the superconductor is surrounded by a heat conducting plate, which is formed of a material having a high thermal conductivity.

4. The magnetic field generator according to claim 1, wherein the refrigerator is constructed in a removable manner.

5. The magnetic field generator according to claim 2, wherein the heat insulating material comprises a laminate of a metallic foil and a resin sheet.

* * * * *